United States Patent [19]

Valenzona et al.

[11] Patent Number: 4,816,626

[45] Date of Patent: Mar. 28, 1989

[54] SLIDE SWITCH

[75] Inventors: Joseph Valenzona, La Mirada, Calif.; Robert J. Smith, Farmington Hills, Mich.

[73] Assignee: Judco Manufacturing Company, Harbor City, Calif.

[21] Appl. No.: 218,160

[22] Filed: Jul. 13, 1988

[51] Int. Cl.[4] ..... H01H 15/00

[52] U.S. Cl. ..... 200/16 F; 200/303

[58] Field of Search ..... 200/16 R, 16 C, 16 D, 200/16 F, 252, 254, 291, 293, 303

[56] References Cited

U.S. PATENT DOCUMENTS

| | | | |
|---|---|---|---|
| 2,162,895 | 6/1939 | Mastney | 200/16 F |
| 3,174,002 | 3/1965 | Golbeck | 200/291 X |
| 4,075,442 | 2/1978 | Fukuda et al. | 200/16 F |
| 4,324,958 | 4/1982 | Valleau | 200/16 F |
| 4,326,110 | 4/1982 | Zdanys, Jr. | 200/16 R |

*Primary Examiner*—J. R. Scott

*Attorney, Agent, or Firm*—Fulwider, Patton, Rieber, Lee & Utecht

[57] ABSTRACT

A slide switch assembly having a slide contact movable by a slide actuator across aligned flat blade contacts of a plurality of electrical terminals fixed in position between complemental halves of an inner housing disposed within an outer housing. The slide actuator and outer housing include complemental detents providing a tactile indication of the attainment by the slide contact of a predetermined switch position relative to the fixed blade contacts. The inner housing includes a pair of resilient, oppositely extending cantilever members engaged upon the slide actuator to bias the complemental detents together to enhance the tactile indication. The arrangement eliminates coil springs, centering balls and the like. The inner housing halves and outer housing are made of plastic material whose resilience is utilized to snap fit them together without the use of conventional fasteners.

12 Claims, 2 Drawing Sheets

SLIDE SWITCH

BACKGROUND OF THE INVENTION

1. Field of the Invention:

The present invention relates to a slide switch assembly, and more particularly to a slide switch assembly which utilizes a bias means to urge a switch actuator into engagement with a switch housing to provide a tactile indication of the attainment of particular switch positions.

2. Description of the Related Art:

Slide switches in various forms are in wide use for a variety of applications.

One form of slide switch includes a plurality of fixed electrical terminals located in a housing assembly and having flat blade contacts aligned in a contact plane. A slide contact is movable in the contact plane to one or more switch positions in which the contact bridges or electrically connects a pair of the fixed terminals.

The slide contact is moved by a slide actuator located in the housing assembly. The slide actuator includes a switch tab which projects out of the housing assembly to enable manual operation of the actuator. The slide actuator also includes a pair of rounded protuberances which are complementally receivable within a pair of recesses in the housing assembly. When the slide contact is moved in one direction to bridge a pair of the fixed contacts, a first switch position is established in which one of the protuberances is aligned with one of the recesses. When the slide contact is moved in the opposite direction, a second switch position is established in which the other protuberance is aligned with the other recess. A tactile indication of the establishment of either of the two switch positions is provided by biasing the slide actuator toward the housing assembly so that a "click" is felt and heard as each protuberance drops into its associated recess.

In very small prior art slide switches of this general type, the bias on the slide actuator is developed by a tiny helical spring housed in a recess in the actuator switch tab. The spring is supported upon a correspondingly small ball which is carried at the center of the slide contact. These small parts undesirably add cost and complexity to the fabrication and assembly of the switch, and the spring itself is characterically prone to fatigue failure after a period of time. In addition to the problems associated with the ball and spring arrangement, such prior art switches also involve tedious staking of the electrical terminals to fix them in position, and crimping of tabs or the like to secure together portions of the housing assembly. Elimination of such staking and crimping operations would desirably reduce the cost of switch fabrication.

SUMMARY OF THE INVENTION

According to the present invention, a slide switch assembly is provided having the usual fixed flat blade contacts aligned in a contact plane, and with a slide contact movable across the fixed contacts by a slide actuator. However, instead of the prior art ball and spring bias means, a pair of resilient members in the form of oppositely extending cantilever arms are employed to bias the slide actuator against the housing assembly which supports the actuator. The cantilever arms contact the actuator at points spaced apart along the actuator path so that the bias force upon the actuator is more uniformly distributed, compared to the single point contact of the prior art ball and spring. The slide assembly components are made of resilient plastic material which enables the components to be configured to snap fit together without any use of staking, crimping or threaded fastener techniques.

The slide switch assembly comprises a pair of inner housing halves which mount the fixed electrical terminals. These are snap fitted together and mounted within an outer housing.

The cantilever arms are molded integral with the inner housing halves, respectively, and are oriented to slidably bear against the inner side of the slide actuator. The inner housing halves also define slideways adjacent the cantilever arms to slidably support the slide contact during its transition from one switch position to another.

Other aspects and advantages of the present invention will become apparent from the following more detailed description taken in conjunction with the accompanying drawings.

DESCRIPTION OF THE PREFERRED EMBODIMENT

Figure 8:
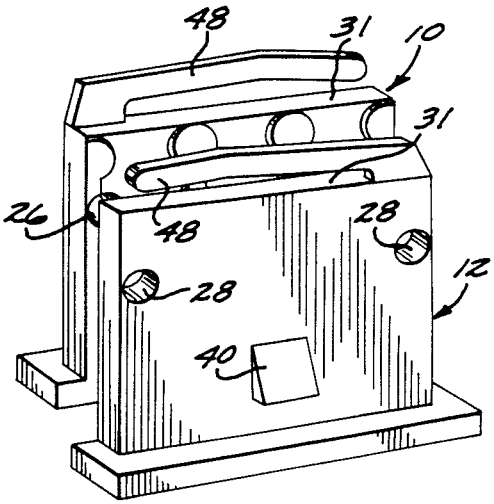
FIG. 8 is a perspective view of the inner housing halves.

Referring now to the drawings, there is illustrated a slide switch assembly according to the present invention which comprises, generally, an inner housing having generally rectangular inner housing halves 10 and 12, as best seen in FIG. 8; a plurality of fixed electrical terminals 14, 16 and 18 sandwiched between the inner housing halves; an electrically conductive slide contact 20 movable across the fixed terminals; a switch actuator 22 operative to move the slide contact; and a hollow, generally rectangular outer housing 24 which houses the foregoing components. All of the components other than the electrically conductive fixed electrical terminals and movable slide contact are made of a suitable molded plastic material characterized by a degree of flexibility and resilience to adapt them for the functions which will be described.

The fixed terminals illustrated are merely exemplary and may take a variety of configurations, but all such configurations are characterized by flat upper extremities or blade contacts aligned in a plane which for convenience is termed a "contact plane".

The electrical terminals 14, 16 and 18 include usual insulated electrical leads crimped or otherwise secured to the blade contacts, respectively. These could also be tabs, rather than leads, extending out of the switch housing and blanked integral with the terminals. Each blade contact includes a wider upper or outer extremity which narrows in an inward direction, then widens, and then narrows again as semi-circular recessed or cut out portions. Inwardly of the cut out portions each blade contact again narrows to the point where it is crimped onto the electrical lead. The terms "inner" and "outer" are used with refernce to the interior and exterior of the switch assembly.

The blade contact edge configuration just described is merely exemplary of various edge configurations which may be encountered. In each instance the housing halves are complementally molded to the edge configuration so that the terminals are held in close fitting, nested relation within the switch assembly, that is, the plastic material of which the housing halves are made enables complemental recesses and projections to be molded in the housing halves to closely receive the particular configuration of the blade contacts. The dimensional tolerances are made such that the terminals are tightly held in position when the housing halves are pressed together.

The housing halves are also provided with interfitting elements or detents to maintain the halves in assembled relation. These may take the form of a plurality of laterally projecting elements or posts 26 and post openings 28 provided in the housing halves 10 and 12, respectively. As will be apparent, the location of the posts and openings relative to the housing halves could be reversed if desired without altering their functions. The posts and openings are characterized by snug fit tolerances such that once the posts are forcibly or snap fitted into the openings 28, their inadvertent separation is virtually impossible.

Figure 4:
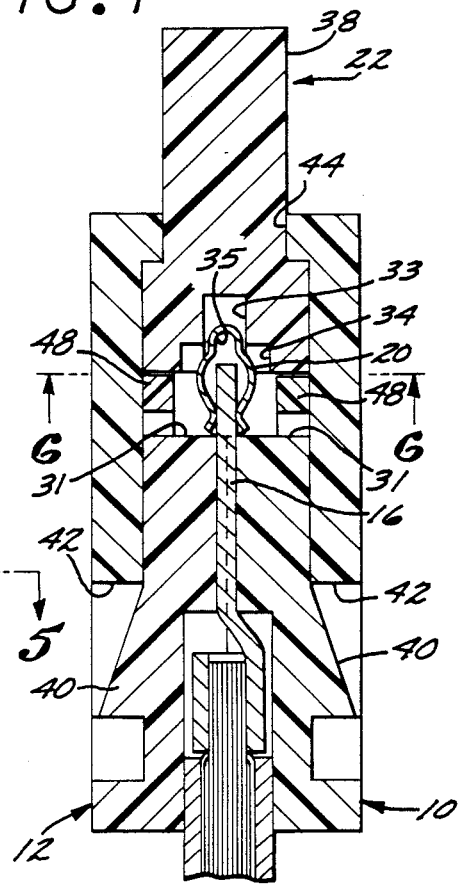
FIG. 4 is a view taken along the line 4—4 of FIG. 3.
Figure 5:
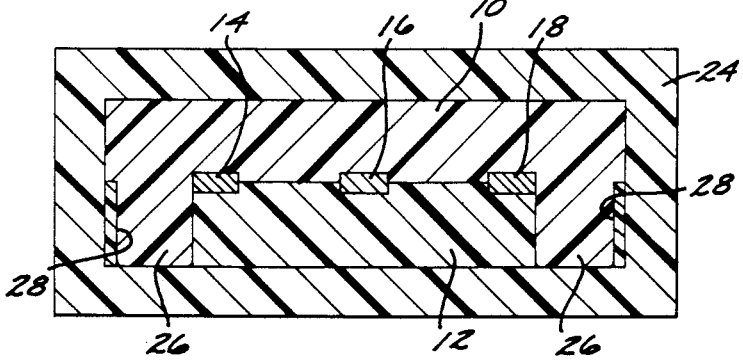
FIG. 5 is a view taken along the line 5—5 of FIG. 3.
Figure 6:
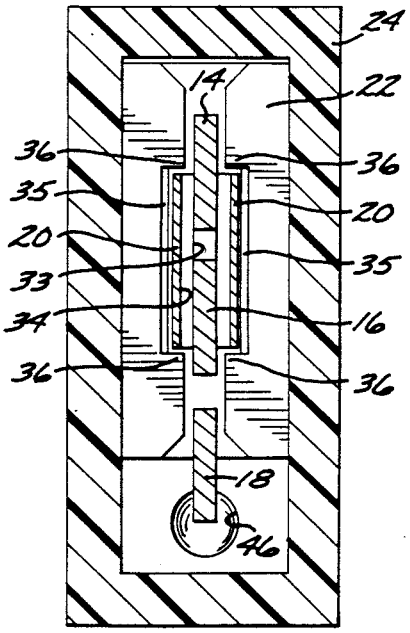
FIG. 6 is a view taken along the line 6—6 of FIG. 4.
Figure 7:
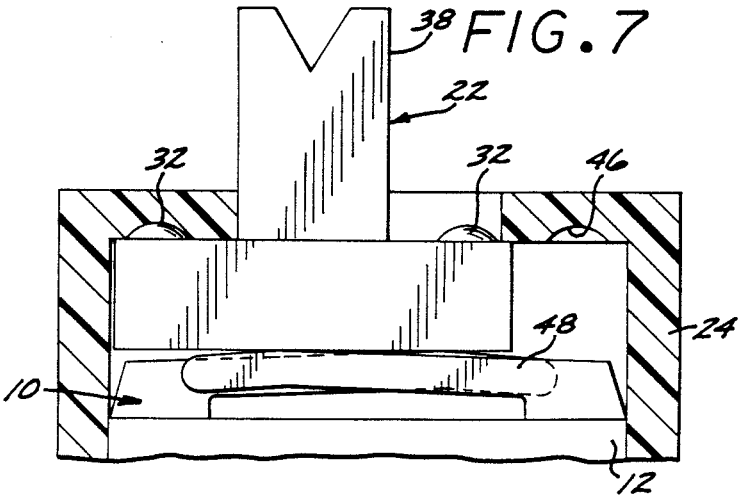
FIG. 7 is a partial longitudinal cross sectional view of the slide switch assembly, illustrating the slide actuator and cantilever arms in side elevation.

The assembled electrical terminals and inner housing halves are next associated with the slide contact 20. The slide contact is of inverted U-shape, as best seen in FIG. 4, and includes an upper or outwardly disposed portion having an arcuate cut out. It further includes a pair of depending legs located in confronting relation, in engagement with the opposite sides of the adjacent fixed terminals. The slide contact is made of electrically conductive, somewhat resilient material so that once the confronting legs are deformed toward each other during fabrication, they will develop a bias against the fixed terminals when they are spread and mounted upon the terminals.

Figure 1:
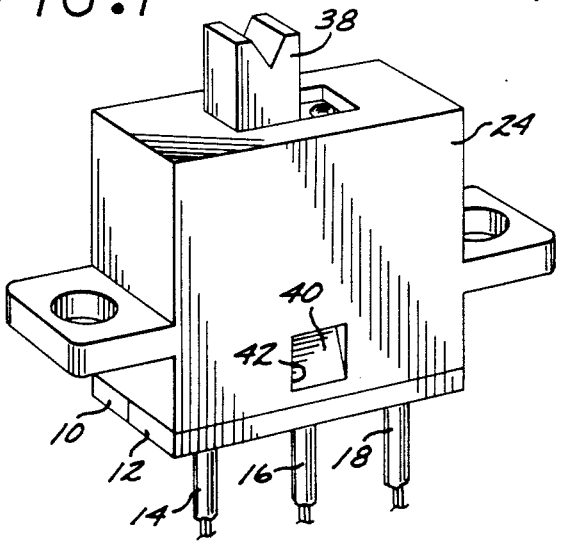
FIG. 1 is a perspective view of a slide switch assembly according to the present invention.
Figure 2:
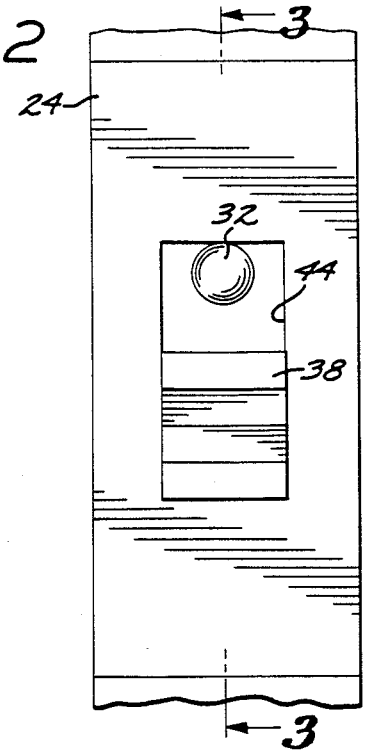
FIG. 2 is a partial top plan view of the slide switch assembly.
Figure 3:
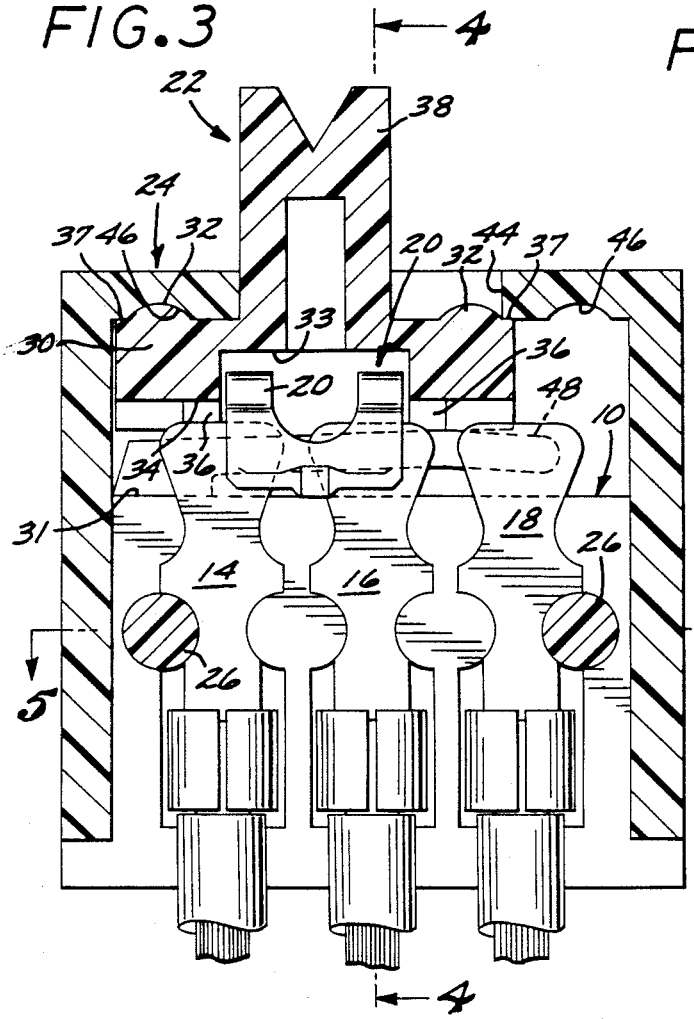
FIG. 3 is a view taken along the line 3—3 of FIG. 2, illustrating the components in a first switch position.
Figure 9:
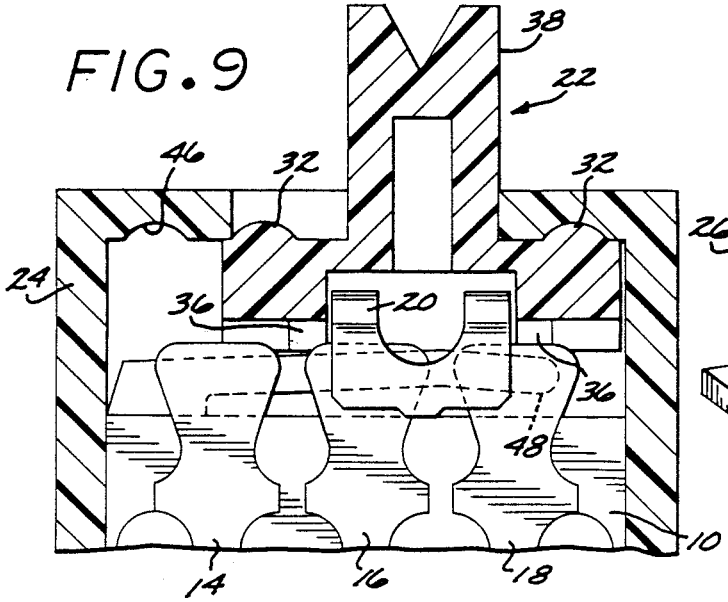
FIG. 9 is a partial longitudinal cross sectional view similar to FIG. 3, but illustrating the components in a second switch position.

As will be seen, the slide contact is engageable at its opposite extremities by the switch actuator 22 for movement in the contact plane between the switch positions illustrated in FIG. 3 and FIG. 9. In the switch position of FIG. 3 the slide contact bridges and electrically connects the fixed terminals 14 and 16, whereas in the switch position of FIG. 9 the terminals 16 and 18 are electrically bridged and connected.

As seen in FIG. 8, the upper portions of the inner housing halves include integral flat surfaces or slideways 31 which slidably support the lower central margins or edges of the slide contact legs, respectively, as seen in FIGS. 3 and 4.

The switch actuator 22 includes a body portion 30 having opposite extremities provided with convex outwardly disposed projections, bumps or detents 32 which are spaced slightly inwardly of the actuator ends to define end shelves 37. The body portion 30 also includes a downwardly or inwardly opening recess 33 having end walls adapted to engage the opposite extremities of the slide contact.

The switch actuator also includes a longitudinally extending channel 34 in communication with the recess 33, and extending the full length of the actuator body portion 30. Integral with the body portion 30 and extending into the channel 34 are pairs of slide posts 36 which also engage the end extremities of the slide contact to facilitate its longitudinal movement along the contact plane.

The differences in the transverse dimensions of the recess 33 and that of the channel 34 define wall portions 35 which are adapted to engage the upper portion of the slide contact and urge it downwardly or inwardly to maintain it in position upon the slideways 31 for proper orientation relative to the fixed blade contacts.

An integral, laterally outwardly projecting portion of the switch actuator defines a switch tab 38 which is manually operable to move the actuator and consequently the slide contact 20 in the recess 33.

The hollow interior of the outer housing 24 is adapted to closely receive the subassembly of the inner housing halves, the slide contact and the switch actuator. For this purpose, as seen in FIG. 4, the outer surfaces of the inner housing halves include integral wedge-shaped detent projections 40, and the corresponding walls of the outer housing include complemental detent openings 42. The resilient plastic material of the inner housing halves and the outer housing is sufficiently yieldable that the subassembly can be relatively forcibly urged into the outer housing until the projections 40 become aligned with the openings 42, at which point the compression forces upon the projections are relieved and they move slightly outwardly to snap fit within the detent openings.

This fixes the inner housing halves in position sufficiently securely that their inadvertent separation from the outer housing is not possible. The basis of the inner housing halves include flanges, as best seen in FIG. 8, which properly locate the subassembly within the housing.

The snug or snap fit assembly of the inner housing halves within the outer housing, and of the inner housing halves to one another eliminates any need for staking of the electrical terminals to fix them in position, and eliminates any need to crimp the outer housing onto the assembled inner housing halves.

The outer housing includes a switch tab opening 44 through which the switch tab 38 projects, the opening being elongated to accommodate the longitudinal movement of the switch tab 38 which is necessary to move the switch actuator between its opposite switch positions.

The inner surfaces of the outer housing which are located adjacent the opposite ends of the switch tab opening 44 are formed to define inwardly facing concave recesses, cavities or detents 46. The detents 46 are each adapted to complementally receive a particular one of the convex switch actuator detents 32, depending upon the switch position of the actuator. In the switch position of FIG. 3 the left detent 32 is located in the left detent 46, and the opposite or right detent 32 is out of alignment with the right detent 46. In addition, the rightmost shelf 37 engages the under or inner side of the end margin of the switch tab opening 44.

A tactile indication of the location of the switch actuator in either opposite switch positions is provided by a forcible biasing or urging of the switch actuator upwardly or outwardly against the outer housing so that the aligned detents 32 and 46 forcibly click together.

The necessary bias force to do this is developed by a pair of resilient, oppositely extending members in the form of cantilever arms 48 which are integral with the upper portions of the inner housing halves 10 and 12, respectively. The cantilever arms are oriented in planes parallel to the contact plane, and they engage the switch actuator body portions at points spaced apart in a direction corresponding to the direction of movement of the switch actuator. When the switch assembly components are assembled, the cantilever arms 48 are depressed or compressed slightly to develop a bias which thereafter tends to forcibly urge the switch actuator upwardly or outwardly. This provides the desired tactile indication of attainment of one or the other of the switch positions by the switch actuator. The arrangement develops the desired bias throughout all portions of the switch actuator travel.

Since the cantilever arms are molded integral with the inner housing halves, they need not be separately assembled when the switch components are put together in production. However, if desired, the bias force could be developed by elongated leaf spring members (not shown) carried in suitable tracks in the housing halves to accommodate their longitudinal movement on deflection.

From the foregoing it will be seen that, in contrast to prior art devices, a switch assembly is provided which is simpler, less expensive, easier to assemble and more reliable in operation. It is particularly unique in its provision of the desired tactile indication of the switch positions by using resilient members such as integral cantilever members which act at spaced apart locations along the length of the slide actuator.

Various modifications and changes may be made with regard to the foregoing detailed description without departing from the spirit of the invention.

We claim:

1. In a slide switch assembly which includes a plurality of electrical terminals having contacts aligned in a contact plane; slide contact means moveable in the contact plane across the contacts to a switch position for electrically coupling an adjacent pair of the contacts; and switch actuator means engaged upon the slide contact means and movable for moving the slide contact means to the switch position, the switch actuator means including first detent means; an improved slide switch assembly for mounting the electric terminals and the switch actuator means, the slide switch assembly comprising:

switch housing means including second detent means complementally engageable with the first detent means, upon attainment of the switch position by the slide contact means, for providing a tactile indication of such attainment, the switch housing means further including resilient, elongated members oriented in planes parallel to the contact plane and engaging the switch actuator means and forcibly urging the first and second detent means into engagement upon such attainment.

2. Switch housing means according to claim 1 in which the switch actuator means is elongated and incorporates a pair of the first detent means, one adjacent each of its opposite extremities, and in which the elongated members comprise oppositely extending cantilever members molded integral with the switch housing means and engaging the switch actuator means at points spaced apart along the length of the switch actuator means.

3. Switch housing means according to claim 1 in which the housing means including inner housing halves having complemental confronting recesses and projections defining terminal seats for holding the electrical terminals, respectively, one of the inner housing halves having posts and the other of the inner housing halves having post openings for snap fitting receipt of the posts, respectively, to fix the terminals in the terminal seats, the cantilever members being integral, respectively with the inner housing halves.

4. Switch housing means according to claim 3 in which the inner housing halves adjacent the cantilever members define slideways slidable supporting the slide contact means.

5. Switch housing means according to claim 4, in which the switch actuator means includes a recess having opposite wall portions engaged upon and urging the slide contact means toward the slideways.

6. Switch housing means according to claim 3 in which the housing means further includes a hollow outer housing closely receiving the inner housing halves, the inner housing halves including a plurality of detent projections, and the outer housing including detent openings for snap fitting receipt of the detent projections to fix the inner housing halves within the outer housing.

7. Switch housing means according to claim 1 in which the switch actuator means is elongated and the first detent means comprises a pair of convex protuberances, one adjacent each of the opposite extremities of the switch actuator means, and in which the second detent means comprises a pair of concave recesses.

8. In a slide switch which includes a plurality of electrical terminals having contacts aligned in a contact plane; slide contact means moveable in the contact plane across the contacts to a switch position for electrically coupling an adjacent pair of the contacts; and switch actuator means engaged upon the slide contact means and movable for moving the slide contact means to the switch position, the switch actuator means including first detent means; an improved slide switch assembly for mounting the electric terminals and the switch actuator means, the slide switch assembly comprising:

switch housing means including inner housing halves having complemental confronting recesses and projections defining terminal seats for holding the electrical terminals, respectively, one of the inner housing halves having posts and the other of the inner housing halves having post openings for snap fitting receipt of the posts, respectively, to fix the terminals in the terminal seats, the housing means further including a hollow outer housing closely receiving the inner housing halves, the inner housing halves including a plurality of detent projections, and the outer housing including detent openings for snap fitting receipt of the detent projections to fix the inner housing halves within the outer housing, the outer housing including second detent means complementally engageable with the first detent means upon attainment of the switch position by the slide contact means for providing a tactile indication of such attainment, the inner housing halves including resilient, oppositely extending cantilever members oriented in planes parallel to the contact plane and engaging the switch actuator means and forcibly urging the first and second detent means into engagement, the inner housing halves adjacent the cantilever members defining slideways slidably supporting the slide contact means, the cantilever members engaging the switch actuator means at points spaced apart in a direction corresponding to the direction of movement of the switch actuator means.

9. A slide switch assembly comprising:

a plurality of electrical terminals having flat blade contacts aligned in a contact plane;

slide contact means of inverted U-shape having opposite extremities and confronting legs engagable upon opposite sides of the blade contacts, the slide contact means being moveable in the contact plane and across the contact blades to a switch position for electrically coupling an adjacent pair of the contact blades;

a hollow outer housing including an elongated switch tab opening, and further including a pair of detent means;

switch actuator means located in the outer housing and including a body portion having opposite extremities and further having a recess defined in part by upper wall portions engaged upon the slide contact means, and by opposite walls engagable upon the opposite extremities of the slide contact means, the body portion further having a pair of detent means, one adjacent each of its opposite extremities, one of which is complementally engagable with one of the pair of detent means of the outer housing, upon attainment by the slide contact means of the switch position, for providing a tactile indication of such attainment, the switch actuator means further including a switch tab projecting laterally of the body portion and out of the switch tab opening and actuable for moving the slide contact means to the switch position; and an inner housing located in the outer housing and including inner housing halves having complemental confronting recesses and projections defining terminal seats for holding the electrical terminals, respectively, the inner housing halves further having, respectively, resilient, oppositely extending cantilever members oriented in planes parallel to the contact plane and engaging the switch actuator means at points spaced apart in a direction corresponding to the direction of movement of the switch actuator means to forcibly urge the first and second detent means into engagement upon such attainment, the inner housing halves further having, respectively, slideways adjacent the cantilever members and engaged by and supporting the legs of the slide contact means.

10. A slide switch assembly according to claim 9 in which one of the inner housing halves includes posts and the other of the housing halves includes post openings for snap fitting receipt of the posts, respectively, to fix the terminals in the terminal seats.

11. A slide switch assembly according to claim 9 in which the inner housing halves include a plurality of detent projections, and the outer housing includes detent openings for snap fitting receipt of the detent projections to fix the inner housing halves within the outer housing.

12. A slide switch assembly according to claim 9 in which the pair of detent means of the body portion of the slide actuator means comprises a pair of convex projections, and the pair of detent means of the outer housing comprises a pair of concave recesses.

* * * * *